US009908225B2

(12) United States Patent
Treviño Cotilla et al.

(10) Patent No.: US 9,908,225 B2
(45) Date of Patent: Mar. 6, 2018

(54) METHOD AND TOOL FOR INSTALLATION OF RETAINER RING

(71) Applicant: Caterpillar Inc., Peoria, IL (US)

(72) Inventors: Jose Abel Treviño Cotilla, Nuevo Laredo (MX); Juan Felipe Grimaldo Perez, Nuevo Laredo (MX); Jose Ricardo Ramirez Gordillo, Nuevo Laredo (MX)

(73) Assignee: Caterpillar Inc., Peoria, IL (US)

( * ) Notice: Subject to any disclaimer, the term of this patent is extended or adjusted under 35 U.S.C. 154(b) by 399 days.

(21) Appl. No.: 14/657,073

(22) Filed: Mar. 13, 2015

(65) Prior Publication Data

US 2016/0263735 A1 Sep. 15, 2016

(51) Int. Cl.
*B25B 5/06* (2006.01)
*B25B 27/20* (2006.01)

(52) U.S. Cl.
CPC ..... *B25B 27/20* (2013.01)

(58) Field of Classification Search
CPC ..... B23P 19/00; B23P 1/00; B23P 5/00
See application file for complete search history.

(56) References Cited

U.S. PATENT DOCUMENTS 1,470,310 A * 10/1923 Winchell ..... B25B 27/023 29/261
5,050,282 A 9/1991 Zannini
5,557,833 A * 9/1996 Pool ..... B25B 27/023 29/261
5,887,328 A * 3/1999 Rydin ..... B25B 27/02 29/259
7,080,432 B2 7/2006 Norwood
7,216,409 B1 * 5/2007 Chiu ..... B25B 27/023 29/255
7,721,613 B2 5/2010 Halbin et al.
8,302,304 B2 11/2012 Stomski

FOREIGN PATENT DOCUMENTS

EP 2540446 8/2014

* cited by examiner

*Primary Examiner* — Lee D Wilson

(57) ABSTRACT

An insertion tool for installation of a retainer ring within a groove is provided. The insertion tool includes a generally horizontal frame member. The insertion tool also includes a handle portion extending upwards from the horizontal frame member. The insertion tool further includes an installation element extending downwards from the horizontal frame member and pivotally attached thereto. The installation element is configured to engage within the retainer ring. Further, the installation element is configured to apply an insertion force on the retainer ring upon rotation of the handle portion about a central axis of the groove to force the retainer ring into the groove. The insertion force acts in a direction generally parallel to the central axis of the groove.

11 Claims, 6 Drawing Sheets

METHOD AND TOOL FOR INSTALLATION OF RETAINER RING

TECHNICAL FIELD

The present disclosure relates to an insertion tool, and more particularly to a tool and method for installation of a retainer ring within a groove.

BACKGROUND

A retainer ring is installed within a groove of a starter drive assembly. The retainer ring locks some components of the starter drive assembly within a casing of the starter drive assembly so that the components do not disengage from the casing during operation of the starter drive assembly. Generally, the retainer rings are inserted manually. The insertion process is done by an operator using a chisel and a hammer. In some situations, the operator may insert up to 600 retainer rings per day, which may generate muscle fatigue due to constant use of the chisel and the hammer. Accordingly, the insertion process is tiresome and prone to errors. Further, being a manual process, the installation of the retainer ring is also subject to process variations.

U.S. Pat. No. 7,080,432 describes a tool for inserting a multi-turn spiral lock, received by a groove of a piston assembly. The tool includes a handle, for transmitting manual torque forces, to enter a spiral, grooved head, or a profiled fitting, a wire lock ring. The spiral, grooved head, is manufactured, with a ½ turn medium-pitched, helical groove. This permits the ½ spire, after being assembled, to be easily pushed, and transferred, to a piston groove. Also, a wire lock end, equipped with a controlled sliding sleeve, allows the ring to be located on the tool, prior to assembly.

SUMMARY OF THE DISCLOSURE

In one aspect of the present disclosure, an insertion tool for installation of a retainer ring within a groove is provided. The insertion tool includes a generally horizontal frame member. The insertion tool also includes a handle portion extending upwards from the horizontal frame member. The insertion tool further includes an installation element extending downwards from the horizontal frame member and pivotally attached thereto. The installation element is configured to engage within the retainer ring. Further, the installation element is configured to apply an insertion force on the retainer ring upon rotation of the handle portion about a central axis of the groove to force the retainer ring into the groove. The insertion force acts in a direction generally parallel to the central axis of the groove.

In yet another aspect of the present disclosure, an insertion tool for installation of a retainer ring on a starter drive assembly is provided. The insertion tool includes a generally horizontal frame member. The insertion tool also includes a handle portion extending vertically upwards from an upper surface of one end of the horizontal frame member. The insertion tool further includes a support element pivotally coupled to another end of the horizontal frame member. The support element includes a reinforcement element configured to contact with a head of the starter drive assembly. The insertion tool includes an installation element pivotally provided on a lower surface of the frame member. The installation element includes a hook portion provided at a free end thereof. The hook portion is configured to engage with at least a portion of the retainer ring. Further, the hook portion of the installation element is configured to contemporaneously exert a force for installing the retainer ring within a groove of the starter drive assembly based on a rotation of the handle portion of the insertion tool about the starter drive assembly.

In yet another aspect of the present disclosure, a method of installing a retainer ring within a groove of a starter drive assembly using an insertion tool is provided. The method includes engaging a hook portion of the insertion tool with a portion of the retainer ring positioned within the groove of the starter drive assembly. The method also includes rotating a handle portion of the insertion tool about the starter drive assembly. The method further includes transmitting, contemporaneously, a force to the hook portion of the insertion tool for installing the retainer ring within the groove.

Other features and aspects of this disclosure will be apparent from the following description and the accompanying drawings.

DETAILED DESCRIPTION

Figure 1:
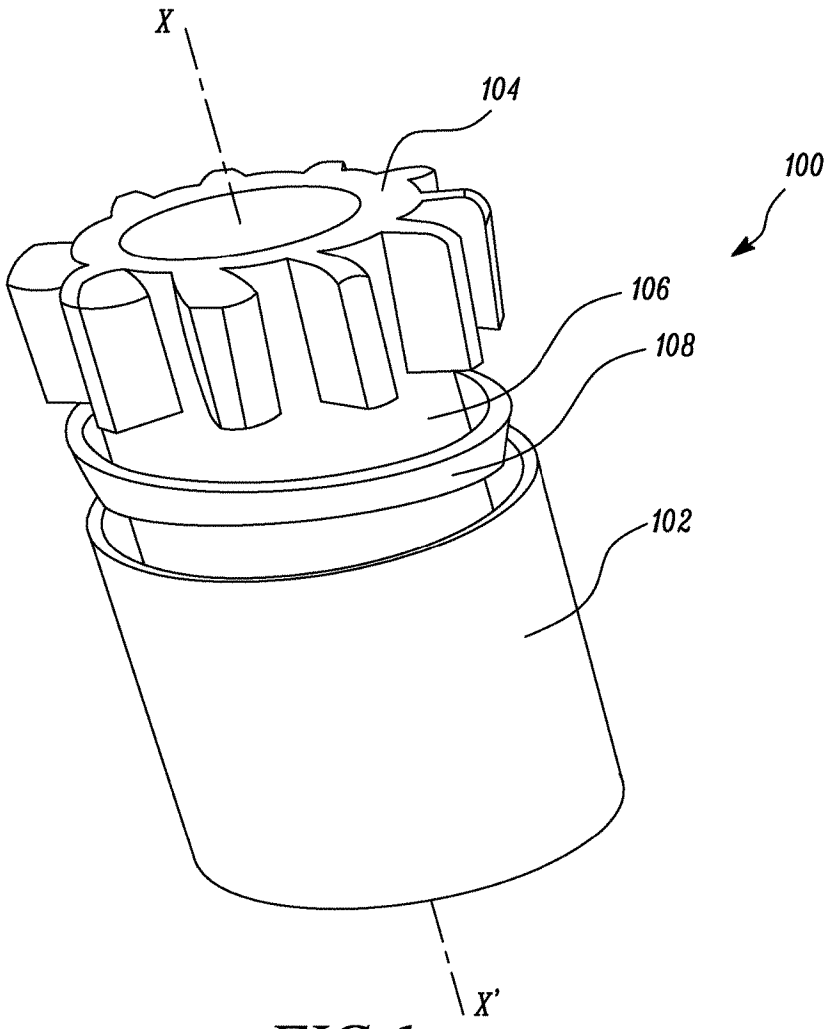
FIG. 1 is a perspective view of an exemplary starter drive assembly, according to one embodiment of the present disclosure.

Wherever possible, the same reference numbers will be used throughout the drawings to refer to the same or the like parts. FIG. 1 is a perspective view of an exemplary starter drive assembly 100 for a starter (not shown), according to one embodiment of the present disclosure. The starter is configured to initiate rotational motion in an internal combustion (IC) engine before the IC engine can power itself. Alternatively, the engine may be a spark ignition engine or a compression ignition engine, such as, a diesel engine, a homogeneous charge compression ignition engine, or a reactivity controlled compression ignition engine, or other compression ignition engines known in the art. The engine may be fueled by gasoline, diesel fuel, biodiesel, dimethyl ether, alcohol, natural gas, propane, hydrogen, combinations thereof, or any other combustion fuel known in the art.

The starter includes a starter motor (not shown) and the starter drive assembly 100 associated with the starter motor. The starter motor may include any one of an electric motor, a pneumatic motor, or a hydraulic motor, but not limited thereto. The starter motor may include an armature (not shown) and an armature shaft (not shown) that rotates when the starter motor is actuated. The starter may also include a solenoid. When current from a starting battery is applied to the solenoid, usually through a key-operated switch, the solenoid actuates a lever that engages the starter drive assembly 100 with a flywheel of the engine.

The starter drive assembly 100 is coupled to the armature shaft and is actuated based on the actuation of the starter motor. The starter drive assembly 100 includes a housing 102. The housing 102 includes a hollow space that may contain, in addition to other components, a spring, a clutch, and a washer therewithin. The starter drive assembly 100 has a pinion gear 104 coupled to a drive shaft 106. Further, the pinion gear 104 is configured to be in selective contact with a ring gear (not shown) of the flywheel of the engine. The pinion gear 104 is clutched to the drive shaft 106 through the clutch which permits the pinion gear 104 to rotate and transmit drive in one direction. Further, when current from the starting battery is applied to the solenoid, the solenoid engages the lever that pushes out the pinion gear 104 on the drive shaft 106 which allows the pinion gear 104 to mesh with the ring gear of the flywheel. Thus, when the starter motor and the solenoid actuate, a rotational motion is transmitted through the pinion gear 104 to the flywheel, via the ring gear.

The starter drive assembly 100 also includes a retainer ring 108. The retainer ring 108 sits within a groove 110 (see FIG. 4) of the starter drive assembly 100. The retainer ring 108 is configured to prevent the components present within the housing 102 of the starter drive assembly 100 to be released during engine operation. The retainer ring 108 is embodied as a locking ring for locking the components of the starter drive assembly 100 within the housing 102. The retainer ring 108 may include a split ring. The retainer ring 108 is open at one side, and is shaped like a "C".

The present disclosure relates to an insertion tool 200 for installing the retainer ring 108 within the groove 110 of the starter drive assembly 100. The construction and working of the insertion tool 200 will be explained in relation to FIGS. 2 to 5.

Figure 2:
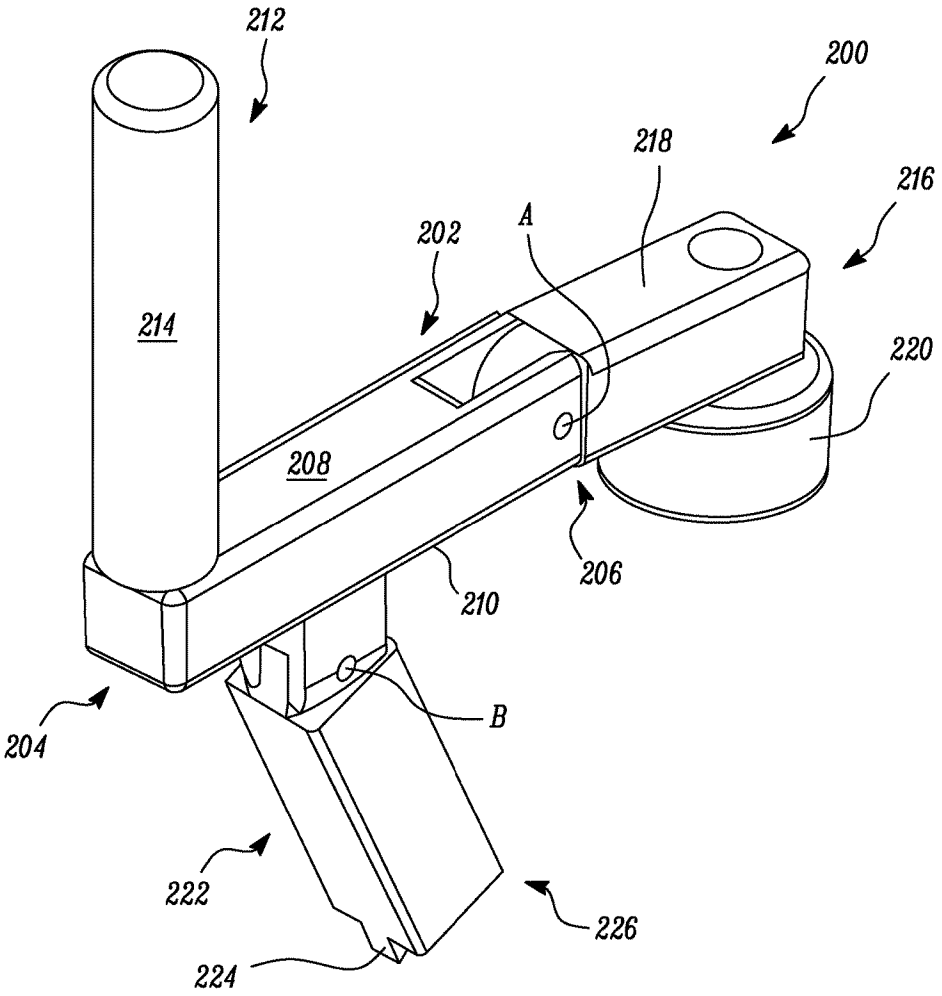
FIG. 2 is a perspective view of an exemplary insertion tool for installing a retainer ring within a groove of a starter drive assembly, according to one embodiment of the present disclosure.
Figure 3:
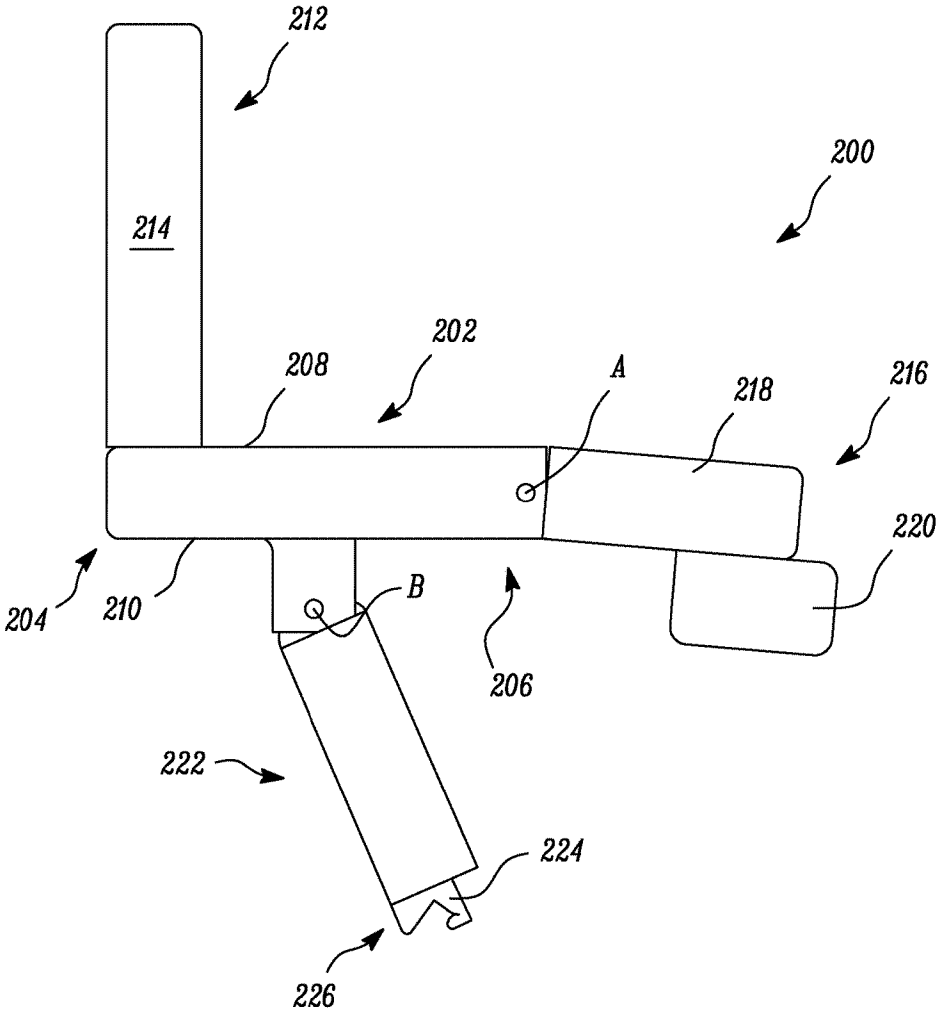
FIG. 3 is a side view of the insertion tool.

Referring to FIGS. 2 and 3, the insertion tool 200 includes a generally horizontal frame member 202. The horizontal frame member 202 has a first end 204 and a second end 206. The horizontal frame member 202 also has an upper surface 208 and a lower surface 210. The horizontal frame member 202 may be a rectangular cross-sectioned bar. The horizontal frame member 202 may include any one of a solid or hollow bar.

The insertion tool 200 includes a handle portion 212. The handle portion 212 extends upwards from the horizontal frame member 202. The handle portion 212 is provided and attached to the first end 204 of the horizontal frame member 202. More particularly, the handle portion 212 is fixedly attached to the upper surface 208 of the horizontal frame member 202. The handle portion 212 includes a gripping surface 214 provided on the handle portion 212. An operator in charge of assembly of the retainer ring 108 grips the handle portion 212 at the gripping surface 214. The handle portion 212 is embodied as a solid cylinder. Alternatively, the handle portion 212 may embody a hollow cylinder.

The insertion tool 200 additionally includes a support element 216. The support element 216 is pivotally coupled to the second end 206 of the horizontal frame member 202, at a pivot point "A". More particularly, a frame member 218 is pivotally coupled to the second end 206 of the horizontal frame member 202, at the pivot point "A". The support element 216 has a reinforcement element 220. The reinforcement element 220 is configured to contact with a head 112 (see FIGS. 4 and 5) of the starter drive assembly 100 during installation of the retainer ring 108. The reinforcement element 220 is circular in shape. The reinforcement element 220 includes a hollow central portion. The hollow central portion of the reinforcement element 220 receives the head 112 of the starter drive assembly 100. Accordingly, a diameter of the reinforcement element 220 is based on a diameter of the head 112 of the starter drive assembly 100. The frame member 218 and the reinforcement element 220 of the support element 216 may be cast as two separate units and later assembled to form the support element 216. Alternatively, the support element 216 may be cast as a unitary component.

As shown in the accompanying figures, the insertion tool 200 includes an installation element 222. The installation element 222 is configured to engage with the retainer ring 108. The installation element 222 is embodied as a solid bar having rectangular cross-section. Alternatively, the installation element 222 may embody a hollow rectangular bar. The installation element 222 extends downwards from the horizontal frame member 202. The installation element 222 may be positioned offset from a central position on the lower surface 210 of the horizontal frame member 202. The installation element 222 is pivotally attached to the lower surface 210 of the horizontal frame member 202 at a pivot point "B".

As shown in FIG. 3, the installation element 222 includes a hook portion 224. The hook portion 224 is provided at a free end 226 of the installation element 222. The hook portion 224 is configured to engage with at least a portion of the retainer ring 108. The hook portion 224 is configured to force or push the retainer ring 108 into the groove 110 during the installation process.

Figure 4:
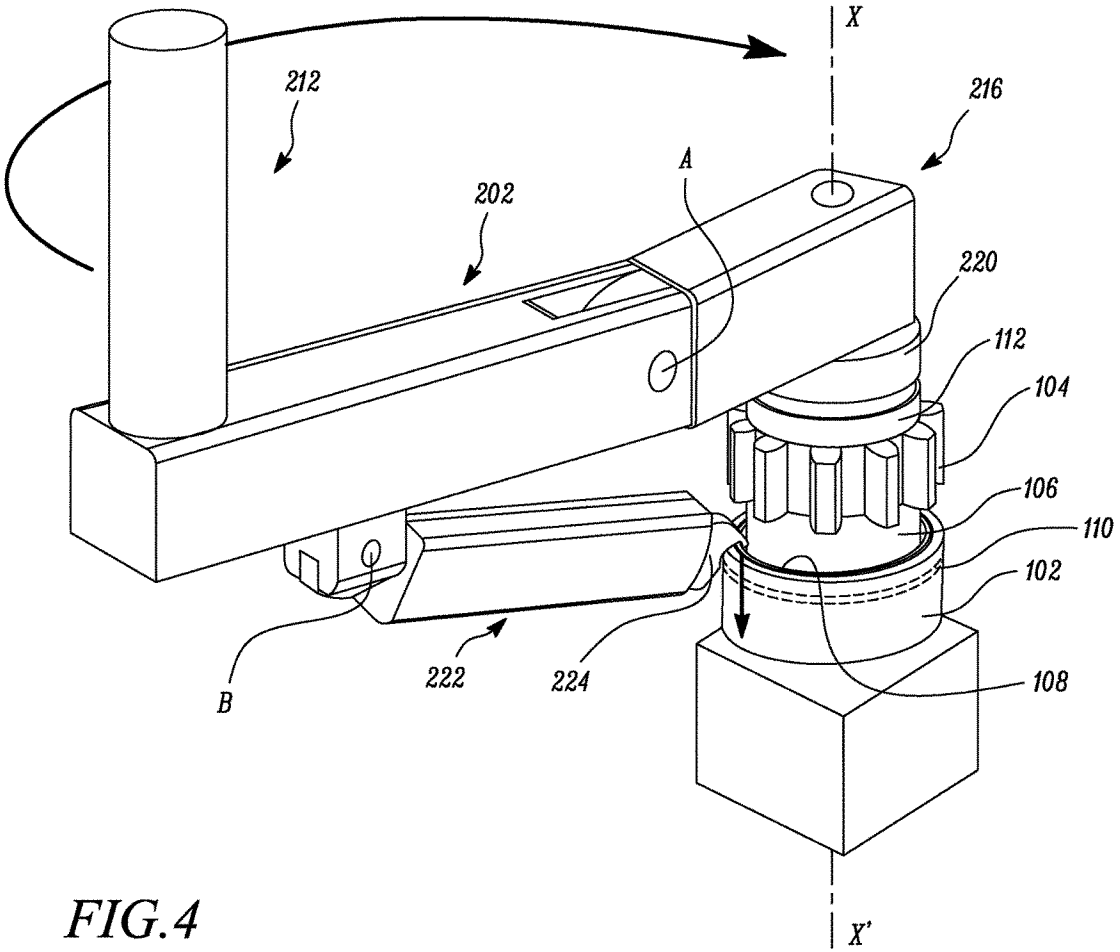
FIGS. 4 and 5 illustrate different views showing the insertion tool positioned with respect to the starter drive assembly during installation of the retainer ring.
Figure 5:
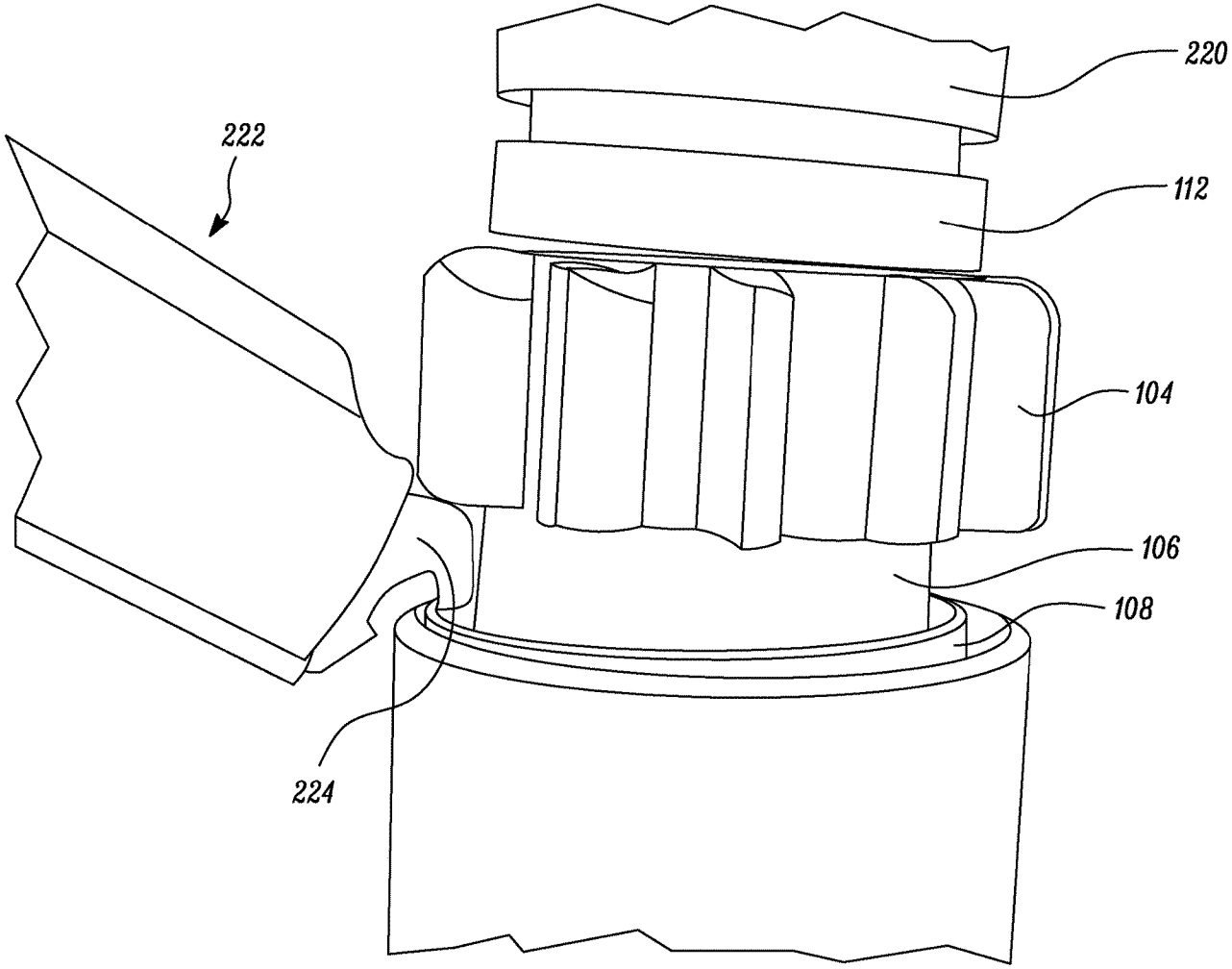

The installation process of the retainer ring 108 is illustrated in FIGS. 4 and 5. Initially, the starter drive assembly 100 is placed on a work bench that has the armature shaft. The armature shaft may function as a fixture to hold the starter drive assembly 100 in place during the installation process of the retainer ring 108. The operator may use a chisel and a hammer to insert a portion of the retainer ring 108 into the groove 110. The operator then positions the retainer ring 108 around the drive shaft 106 of the starter drive assembly 100. Further, the reinforcement element 220 of the insertion tool 200 is positioned on the head 112 of the starter drive assembly 100. Also, the hook portion 224 of the insertion tool 200 is engaged with the portion of the retainer ring 108 inserted into the groove 110. It should be noted that the chisel and hammer may need to be used only once to initially insert the portion of the retainer ring 108 into the groove 110.

The operator holds the gripping surface 214 of the handle portion 212 and rotates the handle portion 212, and thereby the entire insertion tool 200, about the central axis X-X' of the starter drive assembly 100. More particularly, the insertion tool 200 is rotated by 360 degrees about the starter drive assembly 100. The handle portion 212 may be rotated in a clockwise direction (see arrow in FIG. 4). Further, as the operator rotates the insertion tool 200, the horizontal frame member 202 may pivot about the pivot point "A", whereas the installation element 222 may pivot about the pivot point "B".

On account of the external force applied to rotate the handle portion 212, the external force is transmitted from the handle portion 212 to the hook portion 224 of the installation element 222, resulting in an insertion force to be contemporaneously generated for forcing the retainer ring 108 into the groove 110. This insertion force is hereinafter used interchangeably as a contemporaneous force. The contemporaneous force acts in a direction generally parallel to the central axis X-X' of the groove 110 (see arrow in FIG. 4). Due to the contemporaneous force, the retainer ring 108 is automatically inserted into the groove 110 as the handle portion 212 is rotated about the starter drive assembly 100.

The insertion tool 200 disclosed herein may be used for installation of rings, inserts, or washers in application other than that disclosed herein, without limiting the scope of the present disclosure. Further, the components, i.e. the horizontal frame member 202, the handle portion 212, the installation element 222, and the support element 216 may be made of any metal or polymer known in the art, without limiting the scope of the present disclosure. In one example, the components of the insertion tool 200 may be made of steel.

INDUSTRIAL APPLICABILITY

The present disclosure describes the insertion tool 200 for installation of the retainer ring 108 within the groove 110 of the starter drive assembly 100. The insertion tool 200 does not require constant use of a chisel and hammer to install the retainer ring 108 into the starter drive assembly 100. The operator makes use of the chisel only once while positioning one end of the retainer ring 108 within the groove 110 of the starter drive assembly 100.

The insertion tool 200 has a simple design and is easy to manufacture and use. Also, the insertion tool 200 is cost effective. Further, the operator may not experience any muscle fatigue as the operator does not make constant use of chisel and hammer during installation of the retainer ring 108.

Figure 6:
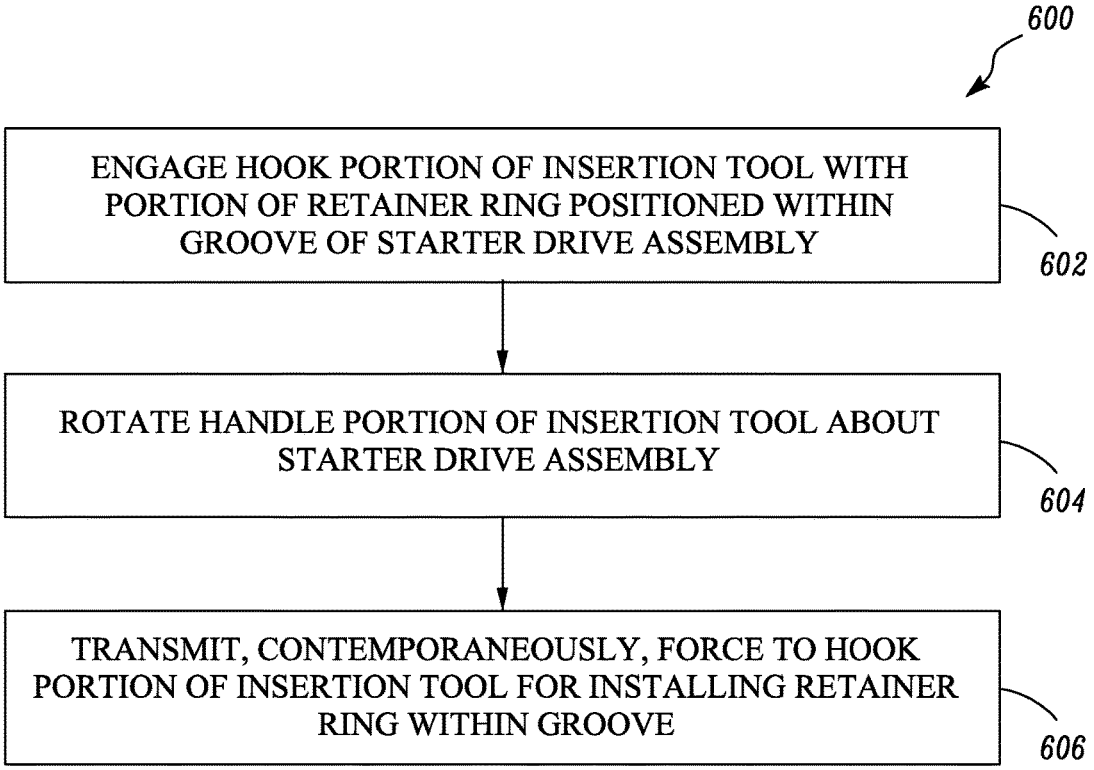
FIG. 6 is a flowchart for a method of installing the retainer ring using the insertion tool.

FIG. 6 is a flowchart for a method 600 of installing the retainer ring 108 within the groove 110 of the starter drive assembly 100 using the insertion tool 200. At step 602, the hook portion 224 of the insertion tool 200 is engaged with the portion of the retainer ring 108 positioned within the groove 110 of the starter drive assembly 100. Also, the reinforcement element 220 of the insertion tool 200 is contacted with the head 112 of the starter drive assembly 100 prior to the rotation.

At step 604, the handle portion 212 of the insertion tool 200 is rotated about the starter drive assembly 100. While installing the retainer ring 108, the reinforcement element 220 is pivoted relative to the horizontal frame member 202 of the insertion tool 200 during the contact of the reinforcement element 220 with the head 112 of the starter drive assembly 100, during the rotation of the handle portion 212 about the central axis X-X', or both. Also, the installation element 222 is pivoted relative to the horizontal frame member 202 of the insertion tool 200 during the contact of the reinforcement element 220 with the head 112 of the starter drive assembly 100, during the rotation of the handle portion 212 about the central axis X-X', or both. At step 606, the contemporaneous force is transmitted to the hook portion 224 of the insertion tool 200 for installing the retainer ring 108 within the groove 110.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. An insertion tool for installation of a retainer ring within a groove, the insertion tool comprising:

a generally horizontal frame member;

a handle portion extending upwards from the horizontal frame member; and an installation element extending downwards from the horizontal frame member and pivotally attached thereto, wherein the installation element is configured to engage within the retainer ring, wherein the installation element is configured to apply an insertion force on the retainer ring upon rotation of the handle portion about a central axis of the groove to force the retainer ring into the groove, the insertion force acting in a direction generally parallel to the central axis of the groove, and further wherein the installation element is offset from a central position on a lower surface of the horizontal frame member.

2. The insertion tool of claim 1, wherein the handle portion is fixedly attached to an upper surface of the horizontal frame member.

3. The insertion tool of claim 1, wherein the handle portion is attached to one end of the horizontal frame member.

4. The insertion tool of claim 2 further comprising a support element pivotally coupled to another end of the horizontal frame member.

5. The insertion tool of claim 4, wherein the support element includes a reinforcement element configured to contact with a head of a starter drive assembly.

6. The insertion tool of claim 5, wherein the reinforcement element is circular in shape such that a diameter of the reinforcement element is based on a diameter of the head of the starter drive assembly.

7. The insertion tool of claim 1, wherein the installation element includes a hook portion provided at a free end of the installation element.

8. The insertion tool of claim 1 further comprising a gripping surface provided on the handle portion.

9. An insertion tool for installation of a retainer ring on a starter drive assembly, the insertion tool comprising:

a generally horizontal frame member;

a handle portion extending vertically upwards from an upper surface of one end of the horizontal frame member;

a support element pivotally coupled to another end of the horizontal frame member, the support element including a reinforcement element configured to contact with a head of the starter drive assembly; and an installation element pivotally provided on a lower surface of the frame member and offset from a central position on the lower surface, the installation element including a hook portion provided at a free end thereof, the hook portion configured to engage with at least a portion of the retainer ring, wherein the hook portion of the installation element is configured to contemporaneously exert a force for installing the retainer ring within a groove of the starter drive assembly based on a rotation of the handle portion of the insertion tool about the starter drive assembly.

10. The insertion tool of claim 9, wherein the reinforcement element is circular in shape such that a diameter of the reinforcement element is based on a diameter of the head of the starter drive assembly.

11. The insertion tool of claim 9 further comprising a gripping surface provided on the handle portion.

* * * * *